US009101231B2

(12) United States Patent
Sosso et al.

(10) Patent No.: US 9,101,231 B2
(45) Date of Patent: Aug. 11, 2015

(54) FREEZER PUSHER

(71) Applicant: The Marco Company, Fort Worth, TX (US)

(72) Inventors: Jerome F. Sosso, Fort Worth, TX (US); Craig Alan Nickell, Fort Worth, TX (US)

(73) Assignee: THE MARCO COMPANY, Ft. Worth, TX (US)

( * ) Notice: Subject to any disclaimer, the term of this patent is extended or adjusted under 35 U.S.C. 154(b) by 121 days.

(21) Appl. No.: 13/874,265

(22) Filed: Apr. 30, 2013

(65) Prior Publication Data

US 2014/0319087 A1 Oct. 30, 2014

(51) Int. Cl.

| | |
|---|---|
| ***A47F 1/04*** | (2006.01) |
| ***A47F 1/12*** | (2006.01) |
| *A47F 3/04* | (2006.01) |

(52) U.S. Cl.

CPC ..... *A47F 1/126* (2013.01); *A47F 3/0486* (2013.01); *Y10T 29/49826* (2015.01)

(58) Field of Classification Search

CPC ..... A47F 1/12; A47F 1/121; A47F 1/125; A47F 1/126; A47F 3/0486

USPC ..... 211/50, 51, 54.1, 57.1, 59.1, 59.2, 59.3, 211/90.01, 90.03, 175, 184; 312/61, 71; 108/60, 61

See application file for complete search history.

(56) References Cited

U.S. PATENT DOCUMENTS

| | | | | | |
|---|---|---|---|---|---|
| 2,111,496 | A | * | 3/1938 | Scriba | 211/59.3 |
| 2,934,212 | A | * | 4/1960 | Jacobson | 211/59.3 |
| 3,110,402 | A | * | 11/1963 | Mogulescu | 211/59.3 |
| 3,279,618 | A | * | 10/1966 | Bergstedt | 211/59.2 |
| 3,308,961 | A | * | 3/1967 | Chesley | 211/59.3 |
| 4,331,243 | A | * | 5/1982 | Doll | 211/59.2 |
| 4,907,707 | A | | 3/1990 | Crum | |
| 5,012,936 | A | | 5/1991 | Crum | |
| 5,069,349 | A | | 12/1991 | Wear et al. | |
| 5,123,546 | A | | 6/1992 | Crum | |
| 5,240,125 | A | | 8/1993 | Kunz | |
| 5,486,046 | A | * | 1/1996 | Jernstrom et al. | 312/408 |
| D375,860 | S | * | 11/1996 | Coretti et al. | D6/566 |
| 5,607,068 | A | * | 3/1997 | Coretti et al. | 211/59.2 |
| 6,142,317 | A | | 11/2000 | Merl | |
| 6,164,462 | A | * | 12/2000 | Mumford | 211/59.2 |
| 6,382,431 | B1 | | 5/2002 | Burke | |
| 6,419,099 | B1 | * | 7/2002 | Weber | 211/184 |
| 6,464,089 | B1 | | 10/2002 | Rankin, VI | |
| 6,691,894 | B2 | | 2/2004 | Chrisman et al. | |
| 6,772,888 | B2 | | 8/2004 | Burke | |
| 6,866,155 | B2 | | 3/2005 | Nagel | |
| 7,918,353 | B1 | | 4/2011 | Luberto | |
| 8,096,427 | B2 | | 1/2012 | Hardy | |
| 8,186,520 | B2 | | 5/2012 | Schneider et al. | |
| 8,210,367 | B2 | | 7/2012 | Nagel et al. | |
| 8,251,233 | B1 | * | 8/2012 | Biglow | 211/59.2 |
| 8,302,784 | B2 | | 11/2012 | Nagel et al. | |
| 8,342,340 | B2 | | 1/2013 | Rataiczak, III et al. | |
| 8,386,075 | B2 | | 2/2013 | Lockwood et al. | |

(Continued)

*Primary Examiner* — Joshua Rodden

(74) *Attorney, Agent, or Firm* — Yee & Associates, P.C.

(57) ABSTRACT

A pusher shelf assembly may comprise a wire grid assembly affixed to a left bracket and to a right bracket. The wire grid assembly may have a plurality of wires and one or more pushers slidingly engaged to at least two wires in the wire grid assembly. The left bracket and the right bracket may be configured for removable engagement to a wall of a product display. The product display may be a freezer.

12 Claims, 6 Drawing Sheets

(56) References Cited

U.S. PATENT DOCUMENTS

| | | | | |
|---|---|---|---|---|
| 8,413,825 | B2 * | 4/2013 | Spizman et al. | 211/184 |
| 2002/0148794 | A1 | 10/2002 | Marihugh | |
| 2004/0099619 | A1 * | 5/2004 | Bustos | 211/59.2 |
| 2004/0256341 | A1 * | 12/2004 | Donnell et al. | 211/187 |
| 2006/0113262 | A1 * | 6/2006 | Knorring et al. | 211/59.2 |
| 2006/0163272 | A1 | 7/2006 | Gamble | |
| 2009/0277853 | A1 | 11/2009 | Bauer | |
| 2012/0211450 | A1 | 8/2012 | Kologe | |
| 2012/0255924 | A1 | 10/2012 | Kologe | |
| 2013/0031815 | A1 | 2/2013 | Hardy | |

* cited by examiner

FREEZER PUSHER

BACKGROUND INFORMATION

1. Field

The present disclosure relates generally to product display, and in particular to product display shelves having a spring driven pusher to force product to the front of the display.

2. Background

In retail stores, shelves are necessary for displaying and storing products. When a product is removed from a shelf, a gap remains on the shelf where the product was stored. Remaining products may be stored further back on the shelf, but may be difficult for a consumer to reach.

A number of different types of devices are known for automatically pushing product forward. For example, gravity fed rollers allow certain products to advance so that a product is always present at the front of the display. Another example is a spring driven pusher plate where the spring driven plate advances toward the front of the display as product positioned between the pusher plate and the front of the display is removed.

Although spring driven pusher plates are known, a number of problems arise in the implementation of current spring driven pusher plates. One problem is that springs may break or lose their force and need to be replaced. Replacement of springs may require disassembly of a tray unit in which the pusher plate operates. A further problem is that products vary in width and displays may need to be reconfigured to accommodate a change in products. A shelf with pushers on fixed tracks may have few or no options for reconfiguring because the pushers cannot be moved about within the shelf.

Accordingly, it would be advantageous to have a method and apparatus, which takes into account one or more of the issues discussed above as well as possibly other issues.

SUMMARY

In one illustrative embodiment, a pusher shelf assembly may comprise a wire grid assembly affixed to a left bracket and to a right bracket. The wire grid assembly may have a plurality of wires. One or more pushers may be slidingly engaged to at least two wires in the wire grid assembly. The left bracket and the right bracket may be configured for removable engagement to a wall of a product display. The product display may be a freezer.

In another embodiment, a method may comprise engaging a base left hook of a pusher to a first wire by pulling the wire toward a center of a pusher shelf assembly, and responsive to engaging the base left hook of the pusher to the first wire, engaging a base right hook of the pusher to a second wire by pulling the second wire toward a center of the pusher shelf assembly.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

In an illustrative embodiment, a pusher tray assembly may be configured for use in a freezer unit.

In an illustrative embodiment, a pusher tray assembly may be configured so that springs may be replaced without dismantling any portion of the pusher tray assembly.

In an embodiment, a pusher tray assembly may be adjusted to accept different product widths.

In an embodiment, a pusher tray assembly may be configured so that pushers may be moved so that areas of the shelf may be divided according to product widths.

Figure 1:
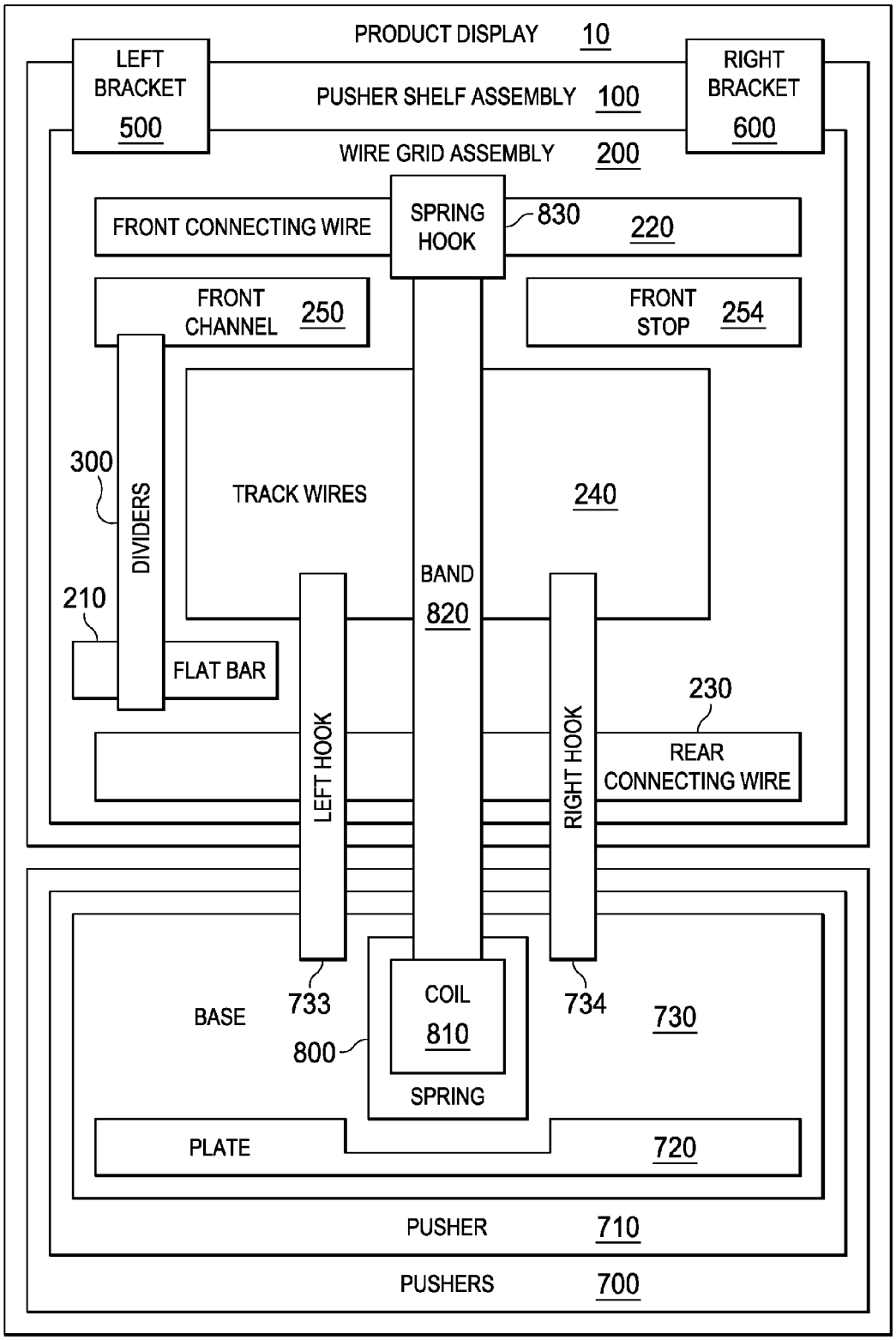
FIG. 1 is an illustration of a block diagram of a freezer pusher assembly in accordance with an illustrative embodiment.

FIG. 1 is an illustration of a block diagram of a pusher tray assembly in accordance with an illustrative embodiment. Pusher shelf assembly 100 is configured for removable engagement with product display 10 via left bracket 500 and right bracket 600. Product display 10 may be a freezer for storage of frozen food product.

Product display 10 may be an open refrigerated display area that keeps product cool but does not keep the product frozen. Product display 10 may be a shelf system for display of packaged food or non-food items for sale.

Pusher shelf assembly 100 may comprise wire grid assembly 200 affixed to left bracket 500 and right bracket 600. Wire grid assembly may comprise track wires 240 affixed to flat bar 210 and front channel 250. Wire grid assembly 200 may also have front connecting wire 220 affixed to track wires 240. Front connecting wire 220 may be generally parallel to front channel 250 and generally perpendicular to track wires 240. Rear connecting wire 230 may stabilize wires in track wires 240. Wire grid assembly 200 may be wire grid assembly 200 in FIG. 2 through FIG. 7.

Pushers 700 such as pusher 710 are connected to track wires 240. Pusher 710 has left hook 733 and right hook 734. Left hook 733 engages one of track wires 240 and right hook 733 engages another wire of track wires 240. Pusher 710 slides along a number of track wires including track wires engaged by left hook 733 and right hook 734. A number, as used herein with reference to an item, means one or more items.

In an illustrative embodiment, pusher 710 travels over four wires of track wires 240 of wire grid assembly 200, a first wire slidingly engaged by left hook 733, a second wire and a third wire running under pusher 710 over which a bottom of pusher 710 slides, and a fourth wire slidingly engaged by right hook 744. Left hook 733 and right hook 744 may be engaged to the first wire and to the fourth wire by manually moving the first wire and the fourth wire toward each other, and then manually releasing the first and fourth wire to engage an interior of left hook 733 and right hook 744 respectively. Pushers 700 such as pusher 710 may be pushers 710 in FIG. 2 through FIG. 9.

Pusher shelf assembly 100 is configured to convey products from the back of pusher shelf assembly 100 to the front of pusher shelf assembly 100 via pushers 700 such as pusher 710 engaged to track wires 240 of wire grid assembly 200. Pusher 710 is powered by spring 800. Spring 800 comprises coil 810, band 820 and spring hook 830. Spring hook 830 may engage front connecting wire 220 and spring coil may be positioned behind plate 720 of pusher 710. Band 820 is the running portion of coil 810 that lengthens as pusher 710 is pushed to the back of wire grid assembly 200 and shortens as pusher 710 moves toward a front of wire grid assembly 200. Spring 800 may be spring 800 in FIG. 2 through FIG. 9.

Dividers 300 may be connected to front channel 250 and to flat bar 210. Dividers 300 may separate products and may be configured depending on the size of product packages. Dividers 300 may be dividers 300 in FIG. 2 through FIG. 6.

Figure 2:
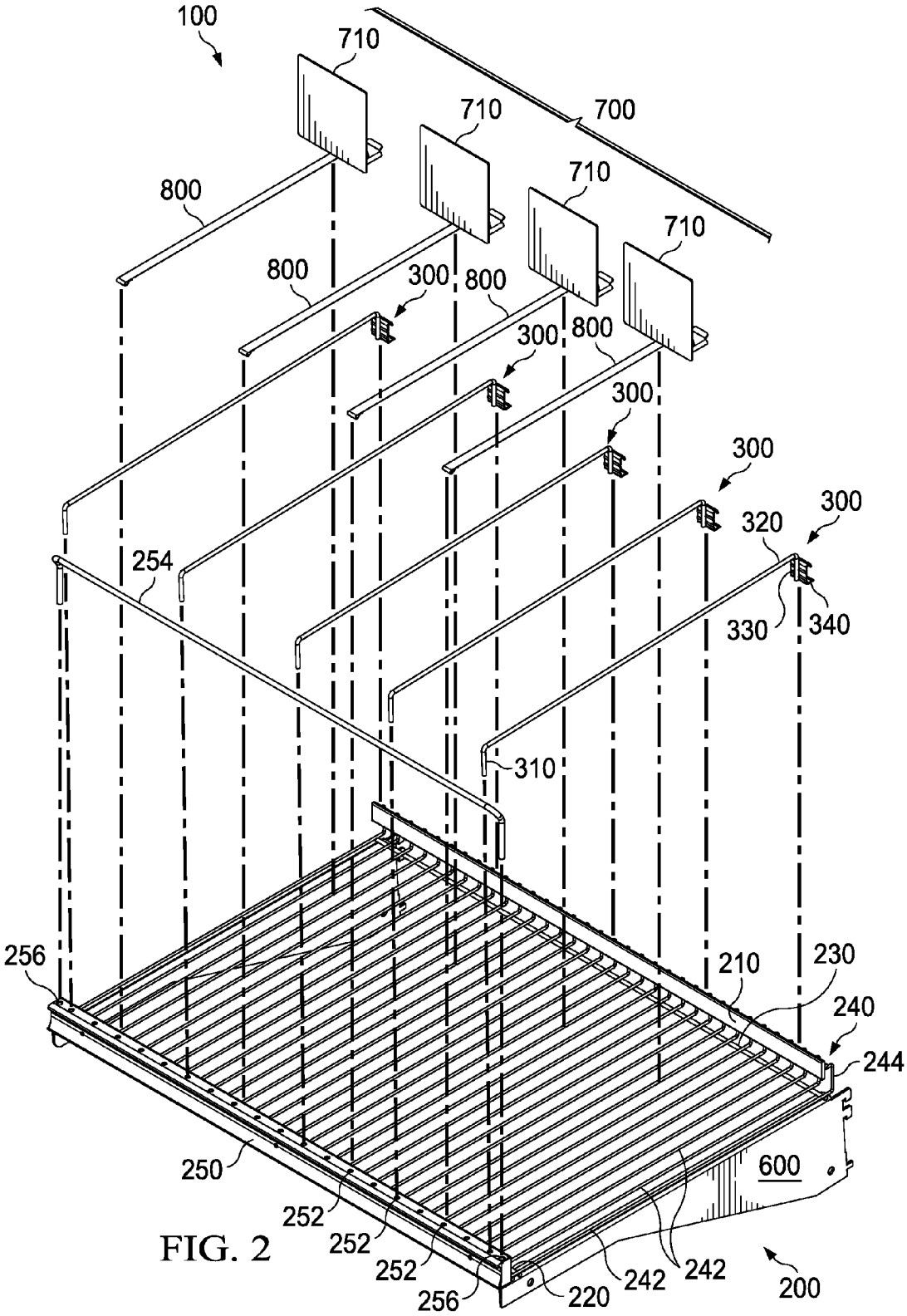
FIG. 2 is an illustration of an exploded view of the freezer pusher assembly in accordance with an illustrative embodiment.

Turning to FIG. 2, an exploded view of the freezer pusher assembly is depicted in accordance with an illustrative embodiment. Pusher shelf assembly 100 comprises wire grid assembly 200, pushers 700, springs 800, left bracket 500, right bracket 600, dividers 300, and front stop 254. In one embodiment, wires in track wires 240 are spaced equidistant from each other and have a front end affixed to front channel 250 and a rear end affixed to flat bar 210. Track wires 240 may comprise a number of individual wires each having a wire grid portion 242 and a wire flat bar portion 244. Each of track wires 240 may have a front portion of wire grid portion 242 affixed to front connecting wire 220 and a rear portion of wire grid portion 242 affixed to rear connecting wire 230. Each wire may bend upward at an approximate 90 degree angle to wire grid portion 242 for a distance to form wire flat bar portion 244 and then bend back toward front of wire grid assembly 200 at an approximate 90 degree angle so that an end of each wire in track wires 240 is engaged to flat bar 210. Front channel 250, front connecting wire 220, rear connecting wire 230 and flat bar 210 run in a direction approximately 90 degrees to track wires 240 and are engaged to each of track wires 240 to give wire grid assembly 200 rigidity. In an illustrative embodiment, front channel 250, front connecting wire 220, rear connecting wire 230 and flat bar 210 are engaged to each wire in track wires 240 by welding. Persons skilled in the art are aware of numerous ways in which the foregoing parts may be joined. In an embodiment, wires such as wires 242 in track wires 240 are parallel to each other at a same distance from each other so that pushers 700 such as pusher 710 may engage pairs of wires for sliding travel along the wires and over additional wires.

Each of dividers 300 has a front end 310, a center 320, and a rear end 330. Front end 310 engages aperture 252 in front channel. Rear end 330 engages clip 340. Clip 340 removably engages flat bar 210. Front stop 254 engages front stop apertures 256 in front channel 250.

Brackets such as left bracket 500 and right bracket 600 may be fixedly engaged to wire grid assembly for installation into a product display.

Figure 3:
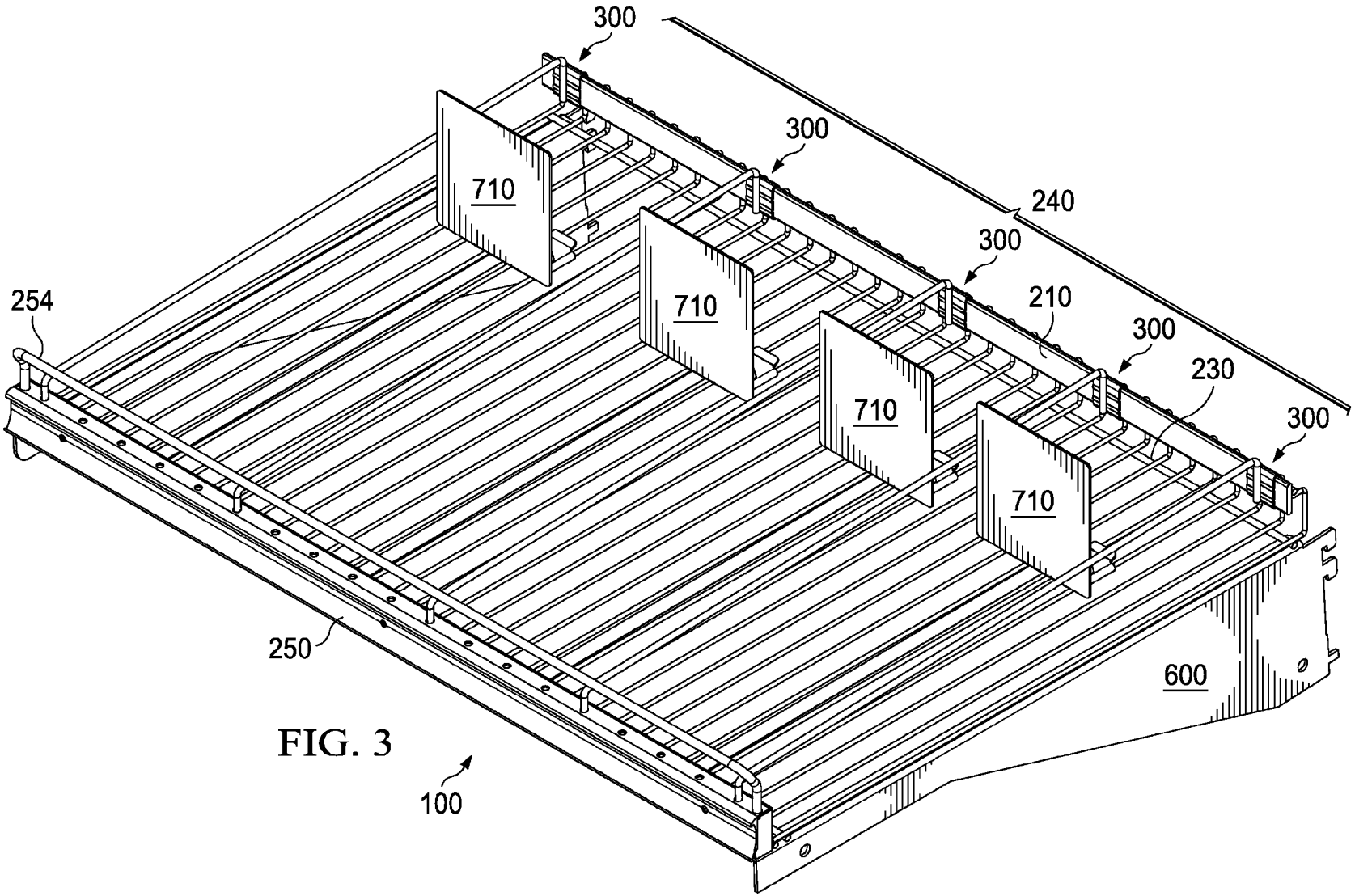
FIG. 3 is an illustration of the freezer pusher assembly in accordance with an illustrative embodiment.

Turning to FIG. 3, an illustration of the freezer pusher assembly is depicted in accordance with an illustrative embodiment. In FIG. 3, pusher shelf assembly 100 is shown with four pushers 710 and five dividers 300 engaged with front channel 250 and flat bar 210. Pushers 710 may be removed from wire grid assembly 200 or installed on wire grid assembly 200 to increase or decrease the number of pushers 710. Dividers 300 may be moved accordingly to accommodate any number of pushers 710 or to accommodate product size.

Figure 4:
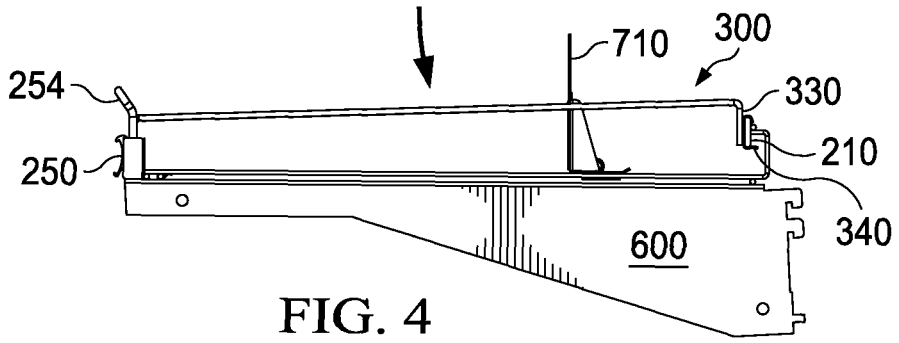
FIG. 4 is an illustration of a divider in a closed position on the freezer pusher assembly in accordance with an illustrative embodiment.
Figure 5:
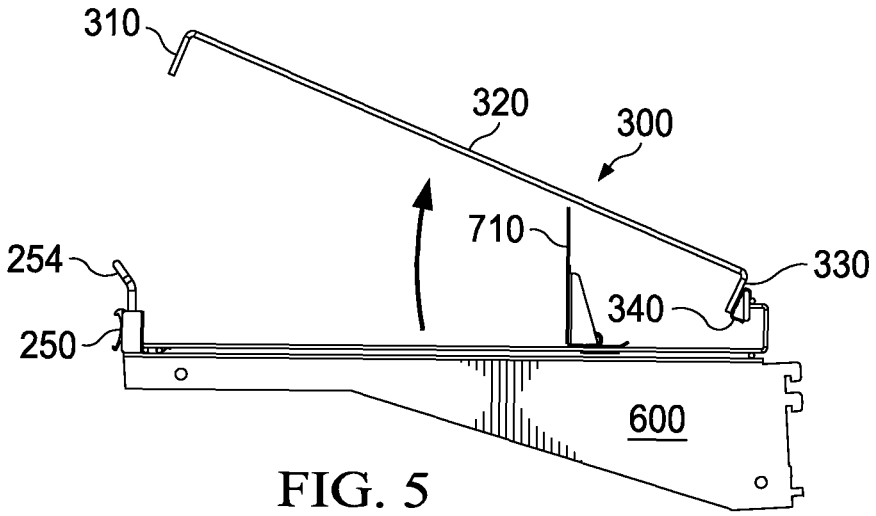
FIG. 5 is an illustration of the divider in an open position on the freezer pusher assembly in accordance with an illustrative embodiment.
Figure 6:
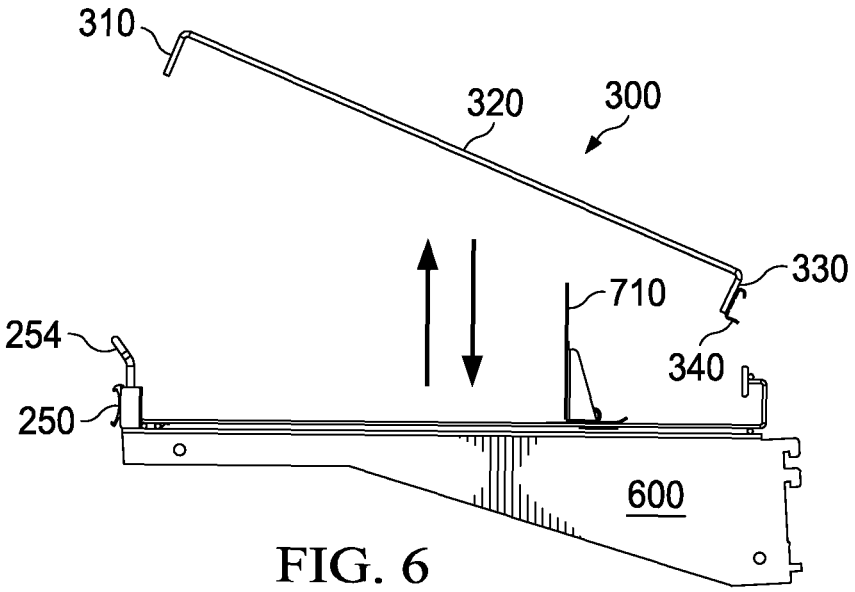
FIG. 6 is an illustration of the divider in position to be attached to the freezer pusher assembly in accordance with an illustrative embodiment.

Turning to FIG. 4 through FIG. 6, installation and removal of a divider 300 is illustrated. FIG. 4 is an illustration of a divider in a closed position on the freezer pusher assembly in accordance with an illustrative embodiment. Divider 300 is disposed on pusher shelf assembly to the right of pusher 710 and is the outermost divider on the right side of pusher shelf assembly 100. Front stop 254 is engaged in front channel 250 and so front end 310 of divider 300 is hidden behind an end of front stop 254. Clip 340 is engaged with flat bar 210.

Turning to FIG. 5 illustrates the divider in an open position on the freezer pusher assembly in accordance with an illustrative embodiment. Divider 300 has been rotated upwards so that front 310 has disengaged from an aperture in front channel 250. Rear end 330 affixed to clip 340 rotates about flat bar 210 as clip 340 disengages from flat bar 210. Divider 300 is now in position to be removed from pusher shelf assembly 100.

Turning to FIG. 6, an illustration of the divider after removal and in position to be attached to the freezer pusher assembly in accordance with an illustrative embodiment. Divider 300 may be removed by continuing to lift divider 300 away from pusher shelf assembly 100. Divider 300 may be re-attached by reversing the process in FIG. 5 and FIG. 4.

Figure 7:
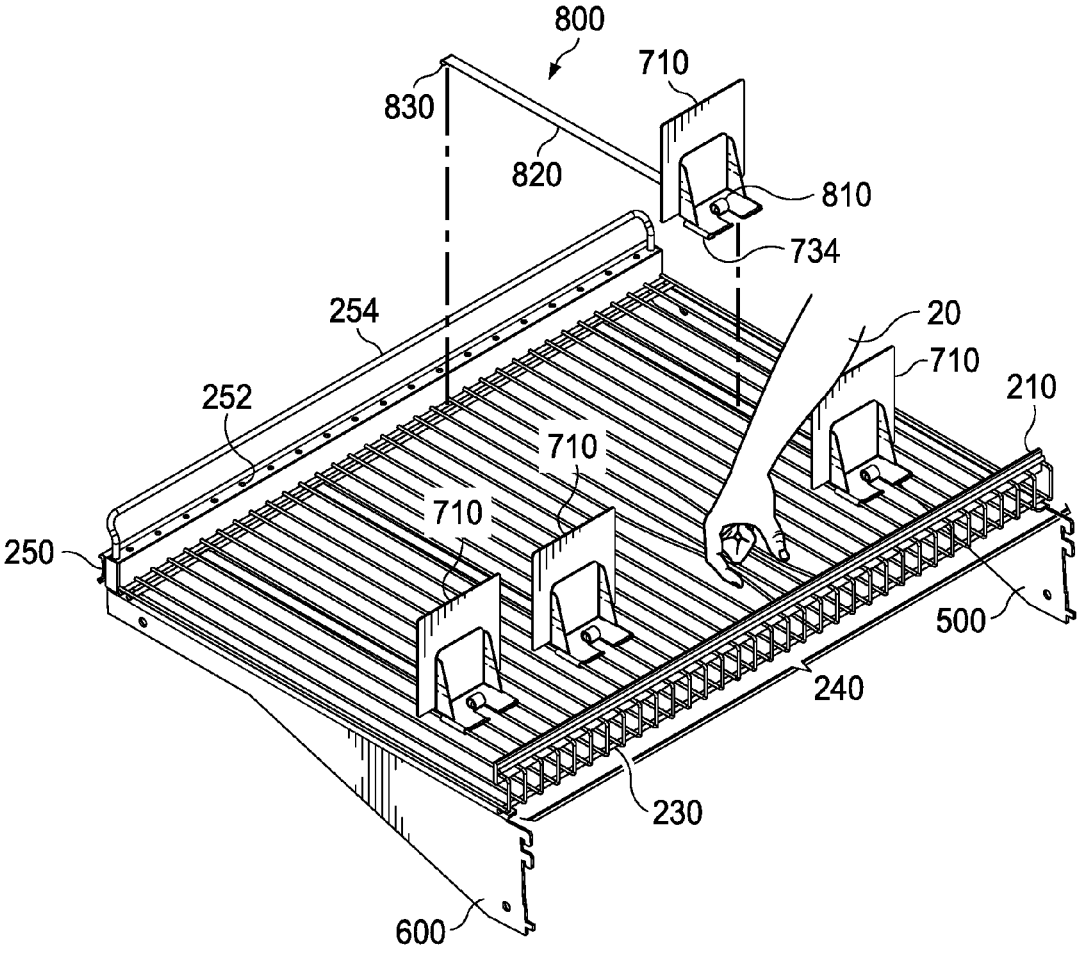
FIG. 7 is an illustration of a method of attaching a pusher to a freezer pusher assembly in accordance with an illustrative embodiment.

Turning to FIG. 7, an illustration of a method of attaching a pusher to a freezer pusher assembly in accordance with an illustrative embodiment is depicted. Pusher 710 is shown above track wires 240. Coil of spring 800 rests on back 730 of pusher 710. Size of coil 810 varies as band 820 is pulled out from coil 810. Hook 830 at end of band 820 is ready for placement around front connecting wire 220. In an embodiment, hook 830 is open and can be slipped over front connecting wire on a portion between two wires of track wires 240. Spring 800 can be easily removed or replaced as coil 810 is held in place on back of pusher 710 by tension when hook 830 is engaged and band 820 is pulled out from coil 810. Pusher 710 has left hook 733 and right hook 734. In an embodiment, pusher 710 is engaged with four of track wires 240. As depicted in FIG. 7, below pusher 710 a group of wires is shown with two wires being manually bent or flexed inward and two wires running straight between the two wires that are being bent or flexed inward. The two wires bending or flexing inward have been moved by a user pinching the two wires toward each other. The two wires are flexible and resilient so that they may bend inward when pinched together by the user and regain their original position after being released by the user. By bending the wires inward, one at a time, pusher 710 can be lowered onto track wires 240 and first one hook such as left hook 733 be engaged with a left wire and then right hook 734 be engaged with a right wire so that pusher 710 rests on all four wire and is held in position by the manner in which left hook 733 and right hook 734 engage respective wires of the group of four wires. In an embodiment, engagement may be left hook 733 and right hook 734 partially wrapping around respective wires of the group of four wires. Persons skilled in the art recognize and take into account that pushers such as pusher 710 may be adapted for engagement with at least two wires and may span two or more wires.

Figure 8:
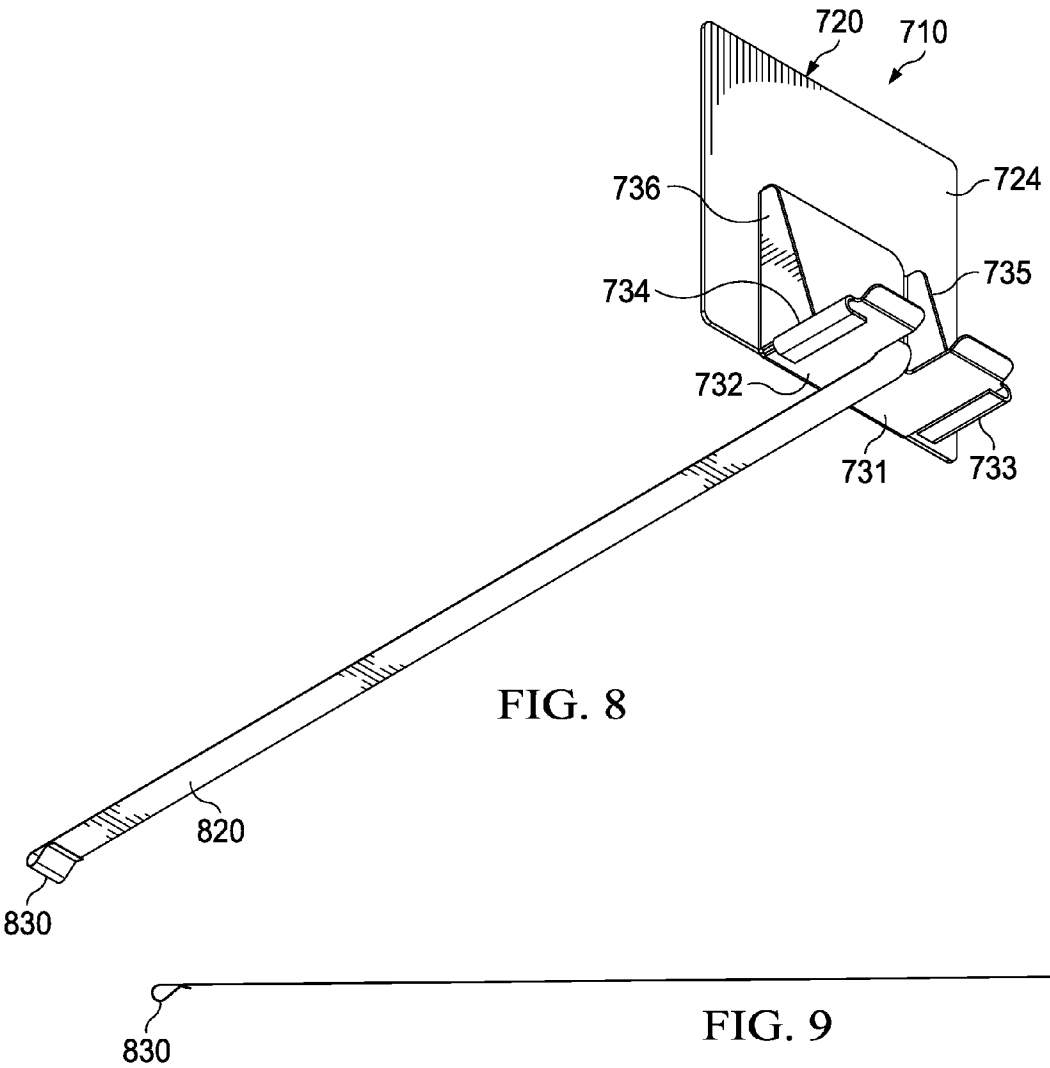
FIG. 8 is a bottom perspective view illustration of an extended spring coil and pusher in accordance with an illustrative embodiment.

Turning to FIG. 8 a bottom perspective view illustration of an extended spring coil and pusher is depicted in accordance with an illustrative embodiment. Left hook 733 and right hook 734 extend downward from base 731. Base 730 has base left section 731 and base right section 732 with a shortened middle section. The shortened middle section is approximately the width of band 820 of spring 800 and is hidden by band 820. Band 820 extends around the shortened section of base 730 so that coil 810 rests on top of shortened section of base 730 and between left brace 735 and right brace 736. Left brace 735 and right brace 735 are affixed to back 724 of plate 720. When stretched out spring 800 exerts pressure to return to a coiled position in which band 820 is coiled in coil 810. The pressure exerted by spring 800 forces pusher 710 to slide along the wires to which it is attached and upon which it rests and push product with plate 720.

Figure 9:
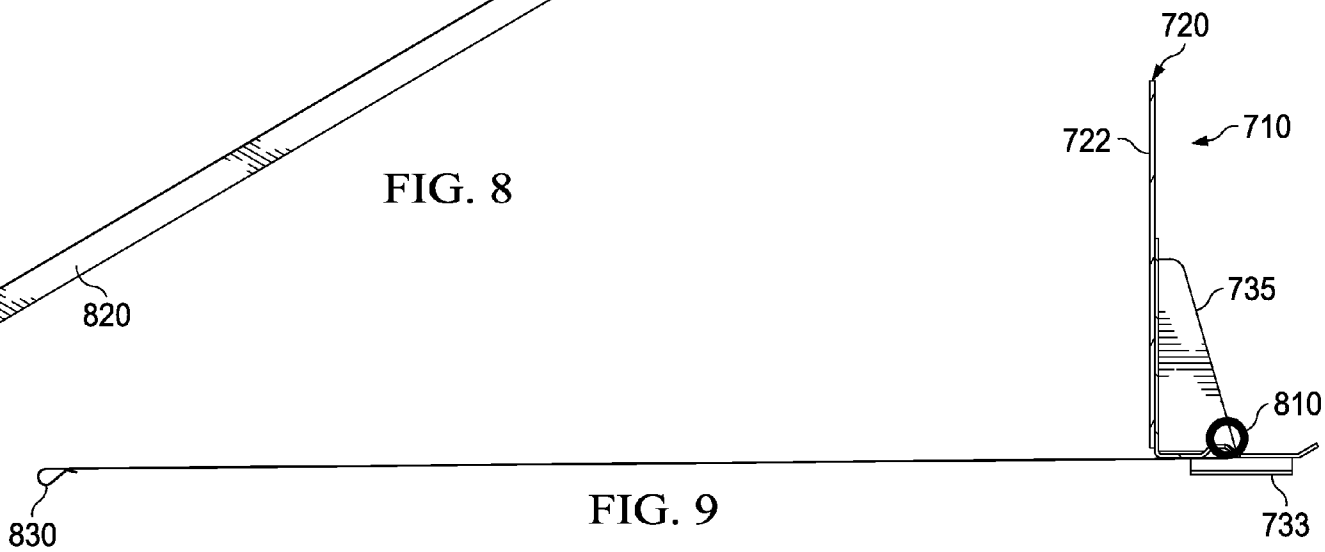
FIG. 9 is an illustration of a cut line down a center of pusher and extended spring in accordance with an illustrative embodiment.

Turning to FIG. 9, an illustration of a pusher and spring along a cut line down a center of pusher and spring is depicted in accordance with an illustrative embodiment. Front 722 of plate 720 is forced forward by pressure of coil 810 as band 820 reverts to coil 810 when hook 830 is engaged.

In an embodiment, a pusher shelf assembly may comprise a wire grid assembly affixed to a left bracket and to a right bracket, a plurality of wires, and one or more pushers slidingly engaged to at least two wires in the wire grid assembly. The left bracket and the right bracket may be configured for removable engagement to a wall of a product display. The product display may be a freezer.

In an embodiment, the wire grid assembly may comprise a plurality of springs. Each spring may pull a pusher from a rear position to a front position. The spring may have a spring coil section and a spring hook section. The spring coil section may rest against a back of a plate of the pusher and a spring hook section may be removably engaged with a front bracket connecting wire.

In an embodiment, a flat bar and a front channel may be affixed to the wire grid assembly.

In an embodiment, the wire grid assembly may further comprise a front bracket connecting wire and a rear bracket connecting wire. A plurality of track wires may be fixedly engaged to the front bracket connecting wire and to the rear bracket connecting wire.

In an embodiment, each track wire may have a wire grid portion and a wire flat bar portion.

In an embodiment, each divider may have a divider front end and a divider rear end and a clip attached to the divider rear end for removable and rotational engagement with the flat bar of the wire grid assembly. The divider rear end may be rotatably secured to the flat bar, the divider may be rotated about the flat bar, and the divider front end may enter a aperture in the front channel to secure the divider. The aperture may be a round hole.

In an embodiment, one or more pushers may have a plate, a base, a base left hook and a base right hook. The base left hook may slidingly engage a first wire and the base right hook may slidingly engage a second wire.

In an embodiment, the pusher may be one of one piece stamped metal, a plurality of pieces welded together, and plastic of unitary construction.

In an embodiment, the pusher travels from a first position to a second position, powered by the spring.

In an embodiment, the left bracket may have a left support section and a left engagement section, and the right bracket may have a right support section and a right engagement section. The left engagement section and the right engagement section may be configured for removably securing the pusher shelf assembly to a product display. The product display may be a freezer wall.

In an embodiment, a pusher shelf assembly may comprise a wire grid assembly affixed to a left bracket and to a right bracket, and may have a plurality of track wires fixedly engaged to a front bracket connecting wire and to a rear bracket connecting wire. The pusher shelf assembly may have a flat bar and a front channel affixed to the wire grid assembly. A clip may be attached to the divider rear end for removable and rotational engagement with the flat bar of the wire grid assembly so that the divider rear end may be rotatably secured to the flat bar and the divider may be rotated about the flat bar. The divider front end may enter a hole in the front channel to secure the divider. One or more pushers may be slidingly engaged to at least two wires in the wire grid assembly. The one or more pushers may have a plate, a base, a base left hook and a base right hook. The base left hook may be slidingly engaged to a first wire and the base right hook may be slidingly engaged to a second wire. The left bracket and the right bracket may be configured for removable engagement to a wall of a product display. The product display may be a freezer.

In an embodiment, the pusher may be one of one piece stamped metal, a plurality of pieces welded together, and plastic of unitary construction.

In an embodiment, the pusher may travel from a first position to a second position, powered by the spring.

In an embodiment, a method may comprise engaging a base left hook of a pusher to a first wire by pulling the wire toward a center of a pusher shelf assembly, and responsive to engaging the base left hook of the pusher to the first wire, engaging a base right hook of the pusher to a second wire by pulling the wire toward a center of the pusher shelf assembly.

In an embodiment, the method may further comprise securing a divider to a wire grid assembly by first engaging a clip attached to a flat bar and locking the clip by rotating the divider until a second end may be inserted in a hole in a front channel of the wire grid assembly.

When one component is "associated" with another component, the association is a physical association in these depicted examples. For example, a first component, flat bar 210, may be considered to be associated with a second component, track wires 240, by being secured to the second component, bonded to the second component, mounted to the second component, welded to the second component, fastened to the second component, and/or connected to the second component in some other suitable manner. The first component also may be connected to the second component using a third component. The first component may also be considered to be associated with the second component by being formed as part of and/or an extension of the second component.

Thus, the illustrative embodiments provide an apparatus for storing products. Further, the illustrative embodiments also may be used to maintain the presence of products at the front of a product display.

The illustrative embodiments provide an apparatus that allows for a reduction in the amount of jostling of shelved products. The illustrative embodiments also provide an apparatus that allows for greater flexibility in placement of dividers. Additionally, the illustrative embodiments provide an apparatus which provides greater structural support. The illustrative embodiments further provide an apparatus that reduces the stress on anchoring points.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A pusher shelf assembly for attachment to a wall of a freezer comprising:

a wire grid assembly affixed to a left bracket and to a right bracket, the wire grid assembly comprising a plurality of substantially parallel wires;

at least one pusher slidingly engaged to at least two of the substantially parallel wires;

a flat bar and a front channel affixed to the wire grid assembly, the flat bar and the front channel substantially normal to the left bracket and the right bracket;

at least one spring pulling the at least one pusher from a rear position to a front position proximate the front channel;

at least one wire divider having a divider front end and a divider rear end; and a clip attached to the divider rear end for removable and rotational engagement with the flat bar so that when the divider rear end is rotatably secured to the flat bar and the at least one wire divider is rotated about the flat bar, the divider front end enters a hole in the front channel to secure the at least one wire divider;

wherein the left bracket and the right bracket are configured for removable engagement to a wall of a freezer.

2. The pusher shelf assembly of claim 1, wherein the spring has a spring coil section and a spring hook section, the spring coil section resting against a back of a plate of the pusher and the spring hook section removably engaged with a front bracket connecting wire.

3. The pusher shelf assembly of claim 1, wherein the wire grid assembly further comprises:

a front bracket connecting wire; and a rear bracket connecting wire;

wherein the plurality of substantially parallel wires are fixedly engaged to the front bracket connecting wire and to the rear bracket connecting wire.

4. The pusher shelf assembly of claim 3 wherein the left bracket has a left support section and a left engagement section, and the right bracket has a right support section and a right engagement section, wherein the left engagement section and the right engagement section are configured for removably securing the pusher shelf assembly to a freezer wall.

5. The pusher shelf assembly of claim 1, wherein each of the plurality of substantially parallel wires has a wire grid portion and a wire flat bar portion.

6. The pusher shelf assembly of claim 1, wherein the at least one pusher has a plate, a base, a base left hook and a base right hook;

wherein the base left hook slidingly engages a first wire of the plurality of substantially parallel wires and the base right hook slidingly engages a second wire of the plurality of substantially parallel wires.

7. The pusher shelf assembly of claim 1, wherein the at least one pusher is one of one piece stamped metal, a plurality of pieces welded together, and of plastic unitary construction.

8. The pusher shelf assembly of claim 1, wherein the at least one pusher travels from a first position to a second position, powered by the at least one spring.

9. A pusher shelf assembly for attachment to a freezer wall comprising:

a left bracket;

a right bracket;

a front bracket connecting wire;

a rear bracket connecting wire;

a wire grid assembly affixed to the left bracket and to the right bracket, the wire grid assembly having track wires fixedly engaged to the front bracket connecting wire and the rear bracket connecting wire;

a flat bar and a front channel affixed to the wire grid assembly;

a clip attached to a divider rear end for removable and rotational engagement with the flat bar of the wire grid assembly so that when the divider rear end is rotatably secured to the flat bar and a divider is rotated about the flat bar, a divider front end enters a hole in the front channel to secure the divider; and at least one pusher slidingly engaged to at least two of the track wires in the wire grid assembly wherein the at least one pusher has a plate, a base, a base left hook and a base right hook, the base left hook slidingly engaging a first wire of the track wires and the base right hook slidingly engaging a second wire of the track wires;

at least one spring having a spring coil section and a spring hook section, the spring coil section resting against a back of the plate of the pusher and the spring hook section removably engaged with the front bracket connecting wire, the at least one spring configured to pull the at least one pusher from a rear position to a front position proximate the front channel;

wherein the left bracket and the right bracket are configured for removable engagement to a wall of a freezer.

10. The pusher shelf assembly of claim 9, where the at least one pusher is one of one piece stamped metal, a plurality of pieces welded together, and of plastic unitary construction.

11. The pusher shelf assembly of claim 10, where the at least one pusher travels from a first position to a second position, powered by the at least one spring.

12. A method of attaching a pusher shelf assembly to a freezer wall, the method comprising:

connecting track wires to a flat bar and a front channel so as to form a wire grid assembly;

engaging a base left hook of a pusher to a first wire of the track wires;

responsive to engaging the base left hook of the pusher to the first wire, engaging a base right hook of the pusher to a second wire of the track wires;

attaching a left bracket to a freezer wall;

attaching a right bracket to the freezer wall, the left bracket and the right bracket connected to the flat bar, the flat bar and the front channel substantially normal to the left bracket and the right bracket; and securing a divider to the wire grid assembly by first engaging a clip attached to the flat bar and locking the clip by rotating the divider until a divider front end is inserted in a hole in the front channel of the wire grid assembly.

* * * * *